US009910396B2

(12) United States Patent
Matsuno

(10) Patent No.: US 9,910,396 B2
(45) Date of Patent: Mar. 6, 2018

(54) IMAGE FORMING APPARATUS

(71) Applicant: KYOCERA Document Solutions Inc., Osaka (JP)

(72) Inventor: Akinori Matsuno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/295,072

(22) Filed: Oct. 17, 2016

(65) Prior Publication Data

US 2017/0139370 A1 May 18, 2017

(30) Foreign Application Priority Data

Nov. 18, 2015 (JP) ..... 2015-225587

(51) Int. Cl.

| | |
|---|---|
| ***G03G 15/00*** | (2006.01) |
| ***G03G 21/16*** | (2006.01) |
| ***H01R 13/74*** | (2006.01) |
| *H01R 103/00* | (2006.01) |
| *H01R 24/78* | (2011.01) |

(52) U.S. Cl.

CPC ..... *G03G 15/80* (2013.01); *G03G 21/1652* (2013.01); *H01R 13/743* (2013.01); *G03G 2221/1678* (2013.01); *H01R 24/78* (2013.01); *H01R 2103/00* (2013.01)

(58) Field of Classification Search

CPC ..... G03G 15/80; G03G 21/1652; G03G 2221/166; H01R 13/74; H01R 13/741; H01R 13/743; H01R 13/745

See application file for complete search history.

(56) References Cited

U.S. PATENT DOCUMENTS

| | | | | |
|---|---|---|---|---|
| 5,414,492 | A * | 5/1995 | Kubota | B41J 13/10 399/111 |
| 5,561,496 | A * | 10/1996 | Sugiura | G03G 15/00 29/469 |
| 2015/0027766 | A1* | 1/2015 | Ogawara | G03G 15/80 174/260 |
| 2017/0139369 | A1* | 5/2017 | Matsuno | G03G 15/80 |

FOREIGN PATENT DOCUMENTS

| | | | |
|---|---|---|---|
| JP | 2002-200816 | A | 7/2002 |
| JP | 2011-215321 | A | 10/2011 |
| JP | 2013-057722 | A | 3/2013 |

* cited by examiner

*Primary Examiner* — Carla Therrien
(74) *Attorney, Agent, or Firm* — Studebaker & Brackett PC

(57) ABSTRACT

An image forming apparatus includes an inlet to which a power cable can connect. The inlet is sandwiched and fixed by two plate members from a direction crossing to a connection direction of the power cable.

5 Claims, 10 Drawing Sheets

IMAGE FORMING APPARATUS

INCORPORATION BY REFERENCE

This application is based on and claims the benefit of priority from Japanese Patent application No. 2015-225587 filed on Nov. 18, 2015, the entire contents of which are incorporated herein by reference.

BACKGROUND

The present disclosure relates to an image forming apparatus which includes an inlet connected to a power cable.

An image forming apparatus, such as a printer and a multifunctional peripheral, is applied with power via an inlet to and from which an AC power cable is inserted and removed. The inlet is attached to an attachment member made of a sheet metal and the attachment member is attached to a side plate of the image forming apparatus in order to prevent the inlet from being damaged or dropping by an external force applied during insertion or removal of the inlet.

The attachment member is formed with an opening part into which the inlet is fitted while the inlet is formed with a lock claw configured to prevent dropping from the opening part. The inlet is fitted into the opening part and then the lock claw is engaged with a periphery of the opening part. In this manner, the inlet is attached to the attachment member. Further, the attachment member to which the inlet is thus attached is supported by the side plate to which an electrical substrate is attached and then the inlet is connected to the electrical substrate via wires.

The inlet includes two types: one of the two types is provided with an inlet single body having an input terminal and an output terminals while the other is provided with an inlet single body having an input terminal and an output terminal to which a wire is connected. Both of the two types need to be fitted into the opening part of the attachment member. Further, there is also a case where the attachment member is supported by the side plate via an opening formed in the side plate. Hence, there are many cases where, after the attachment member to which the inlet is attached is supported by the side plate, the output terminal or the wire connected to the output terminal are connected to the electrical substrate via connectors.

Thus, in order to attach the inlet, the attachment member made of a sheet metal and the connectors are necessary. Further, an operation of attaching the inlet to the side plate requires an operation of attaching the inlet to the attachment member, an operation of attaching the attachment member to which the inlet is attached to the electrical substrate and also attaching the electrical substrate to the side plate, and an operation of electrically connecting the inlet to the electrical substrate. Furthermore, when a shield member for electrically shielding the electrical substrate is attached, an operation attaching the shield member to the side plate is added after the operation of attaching the electrical substrate to the side plate.

In recent years, as cost of the image forming apparatus becomes lower, it is demanded to reduce the number of parts which constitute the image forming apparatus and reduce assembly processes. Therefore, it is demanded to reduce the number of parts and assembly processes to attach the inlet to an apparatus main body.

SUMMARY

In accordance with an embodiment of the present disclosure, an image forming apparatus includes an inlet to which a power cable can connect. The inlet is sandwiched and fixed by two plate members from a direction crossing to a connection direction of the power cable.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to figures, an image forming apparatus according to an embodiment of the present disclosure will be described.

Figure 1:
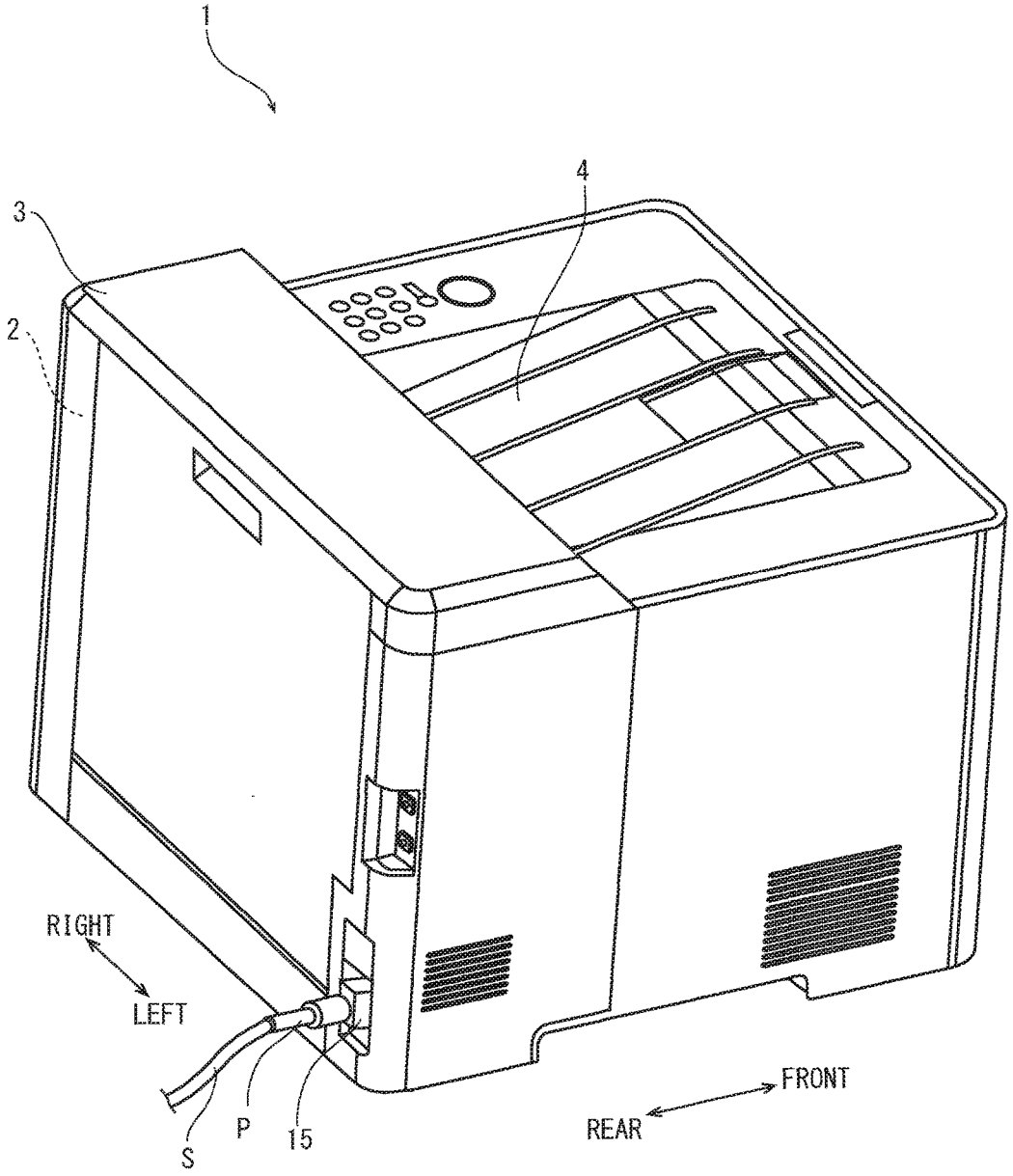
FIG. 1 is a perspective view showing a color printer according to one embodiment of the present disclosure.

First, a color printer as an image forming apparatus according to one embodiment of the present disclosure will be described with reference to FIG. 1. FIG. 1 is a perspective view showing the color printer. Front, rear, left and right directions in the following description are based on a front, rear, left and right directions shown in FIG. 1.

An image forming apparatus 1 includes a rectangular parallelepiped shaped housing 2 in which an image forming part is stored, and exterior covers 3 which cover an outer circumference of the housing 2. The exterior cover 3 covering an upper face of the housing 2 is formed with an ejected sheet tray 4. In the housing 2, a sheet feeding cassette in which sheets are stored and the image forming part which forms images on the sheet are stored. Further, in the housing 2, a sheet feeding and conveying part which feeds the sheet from the sheet feeding cassette and conveys the sheet toward the ejected sheet tray 4 via the image forming part is formed.

The image forming part includes four image forming units which form toner images in an electrographic manner. Each image forming unit is provided for every color of toner and is constituted by various components, such as a photosensitive drum, a charging device, a developing device and a cleaning device. Each component is driven by a driving transmitting mechanism. The driving transmitting mechanism is constituted by a motor, a gear train which transmits a driving force of the motor to each component of each image forming unit and the like.

Figure 2:
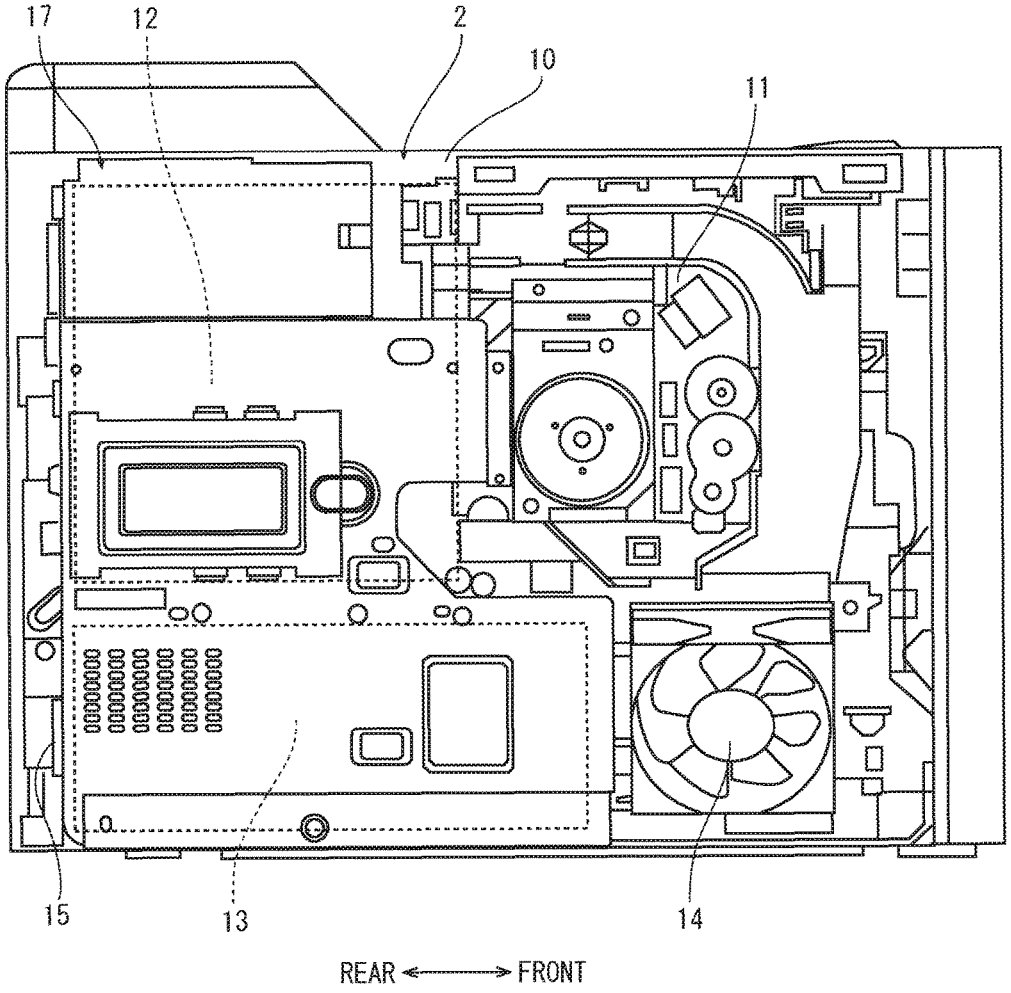
FIG. 2 is a view showing a left side face of a housing of the color printer according to one embodiment of the present disclosure.

Next, the housing 2 will be described with reference to FIG. 2. FIG. 2 is a view showing a left side face of the housing.

On the left side face of the housing 2, a base member 10 is provided. On an outer face of the base member 10, a driving transmitting mechanism supporting plate 11, a main substrate 12, a power supply substrate 13, a fan 14, an inlet 15 and the like are supported. The driving transmitting mechanism supporting plate 11 is configured to support the driving transmitting mechanism. The main substrate 12 is configured to control driving of the image forming part and a sheet feeding and conveying part. The power supply substrate 13 is configured to supply power to the image forming part and the sheet feeding and conveying part. The inlet 15 is configured to be capable of being connected to a plug P of an AC power cable S connected to an external power supply. Further, on the outer face of the base member 10, a shield member 17 which electrically shields the main substrate 12 and the power supply substrate 13 is fixed.

The driving transmitting mechanism supporting plate 11 is supported on a front upper portion of the outer face of the base member 10. The fan 14 is supported below the driving transmitting mechanism supporting plate 11. The main substrate 12 is supported on a rear upper portion of the outer face of the base member 10. The power supply substrate 13 is supported below the main substrate 12. The main substrate 12 of a substantially square shape has a CPU, a memory, various electrical parts and connectors, which are mounted on the both faces. The power supply substrate 13 of a horizontally long rectangular shape has various parts, such as a capacitor and a transformer, which are mounted on the both faces. Further, the inlet 15 is supported on the rear side of the power supply substrate 13. The shield member 17 is fixed to the base member 10 to cover the main substrate 12 and the power supply substrate 13.

Figure 3:
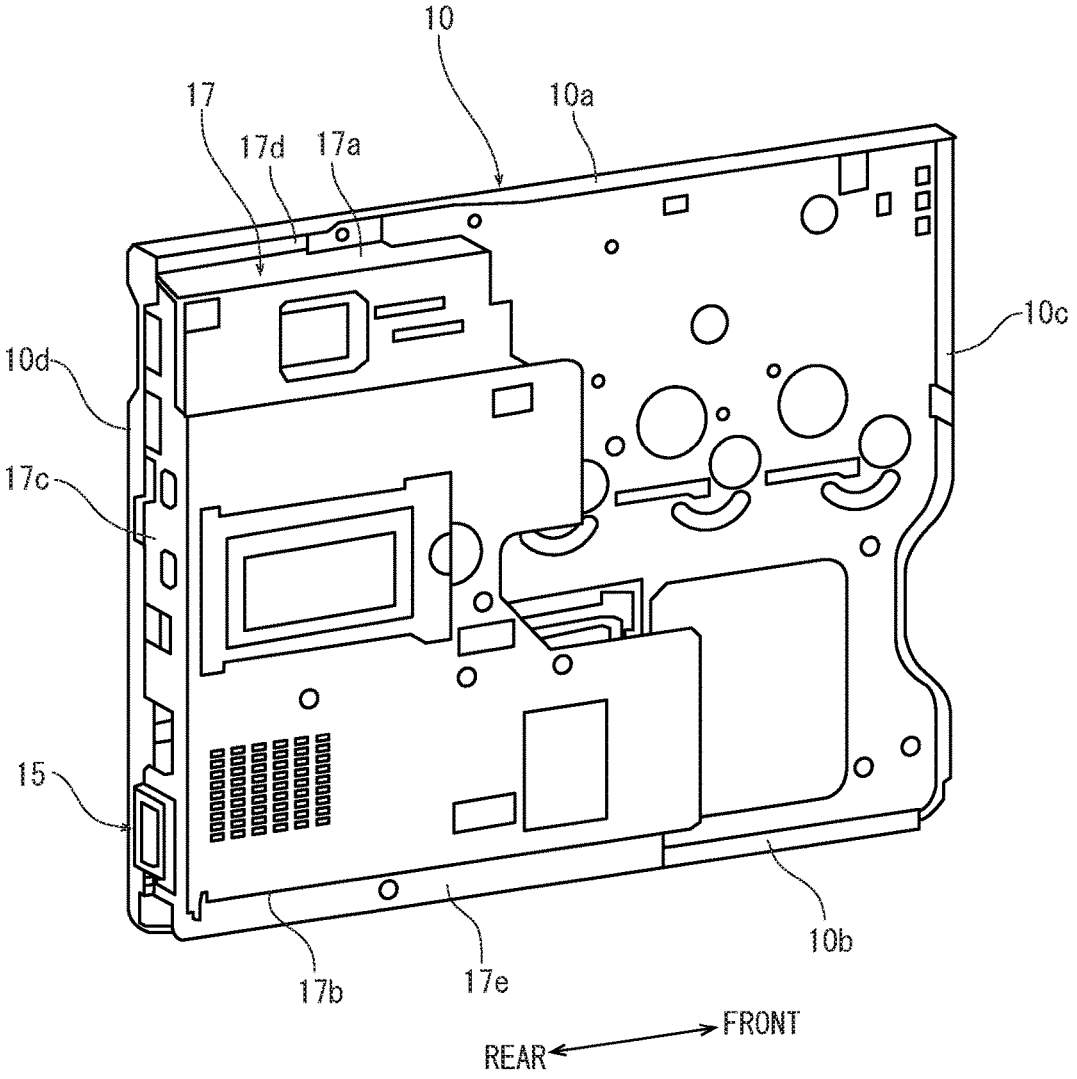
FIG. 3 is a perspective view showing a base member and a shield member of the color printer according to one embodiment of the present disclosure.
Figure 4:
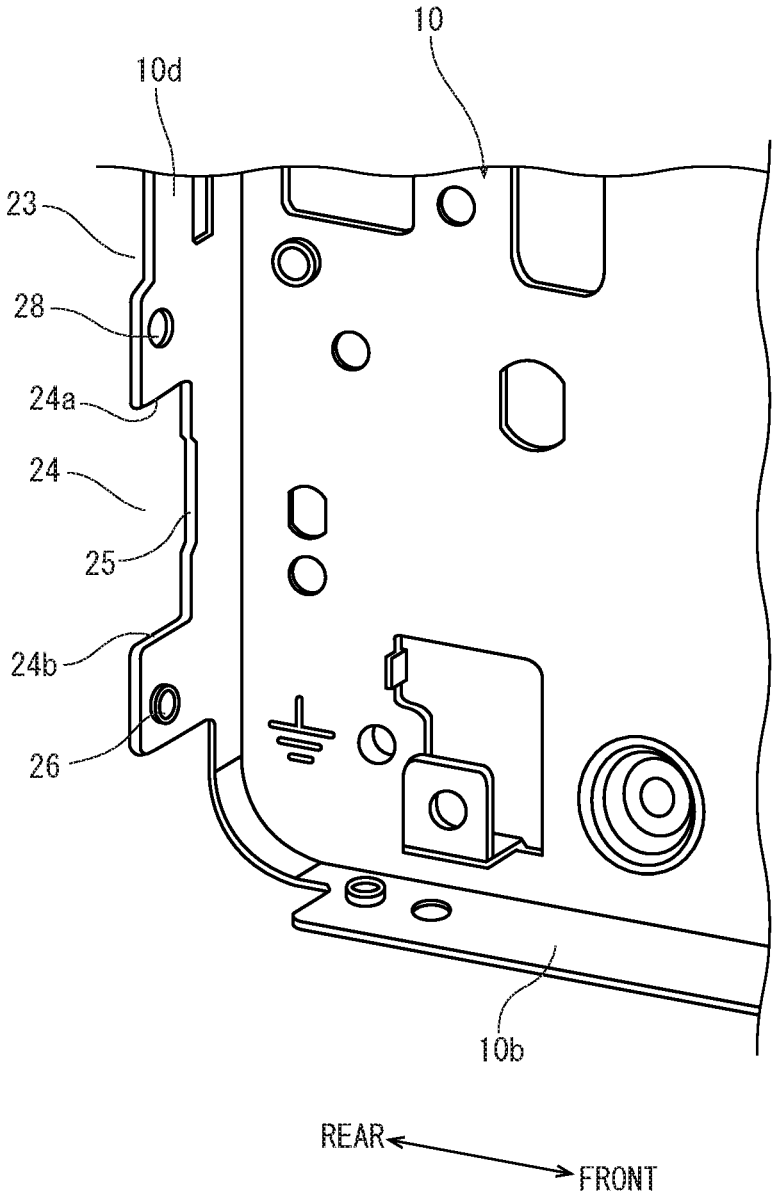
FIG. 4 is a perspective view showing a rear lower corner portion of the base member, in the color printer according to one embodiment of the present disclosure.
Figure 5:
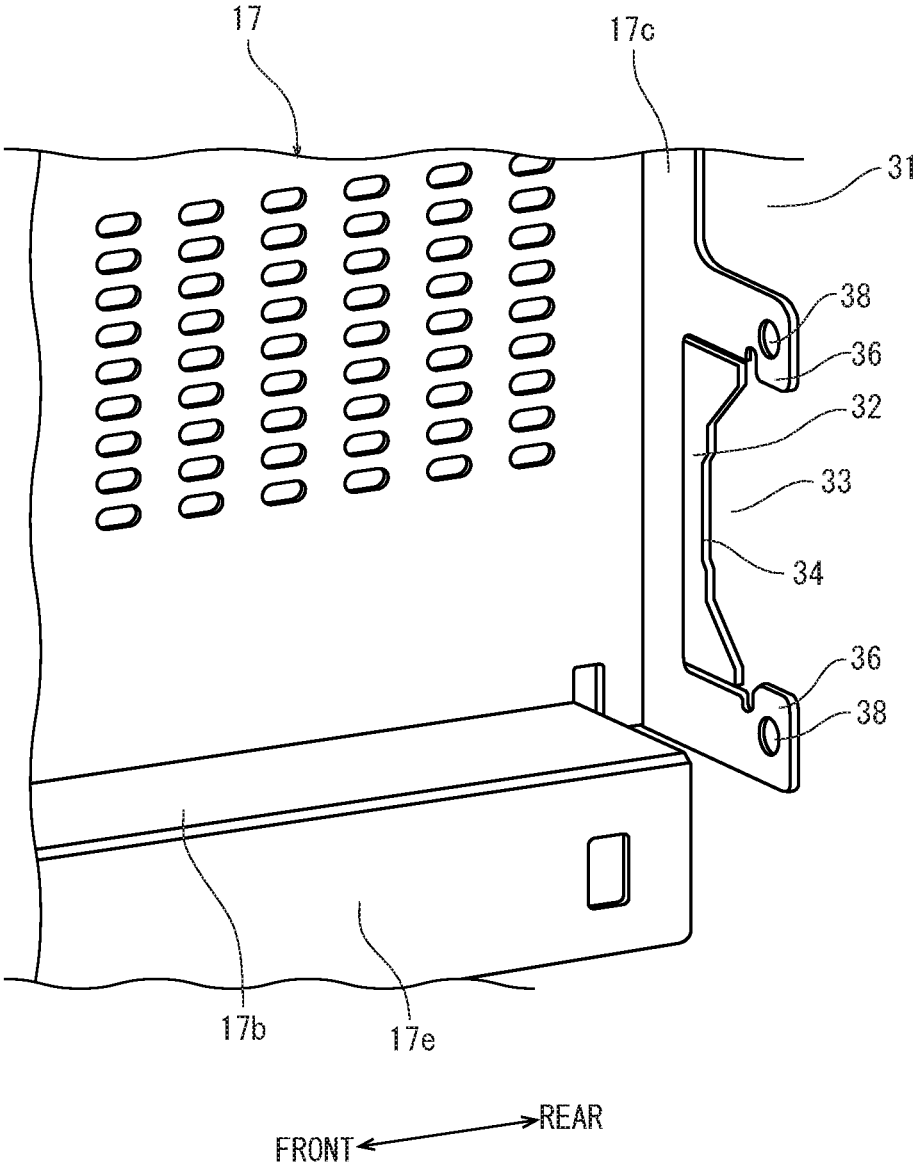
FIG. 5 is a perspective view showing a rear lower corner portion of the shield member, in the color printer according to one embodiment of the present disclosure.

Next, the base member 10 and the shield member 17 will be described with reference to FIGS. 3 to 5. FIG. 3 is a perspective view showing the base member and the shield member, FIG. 4 is a perspective view showing a rear lower corner portion of the base member, and FIG. 5 is a perspective view showing a rear lower corner portion of the shield member. The base member 10 and the shield member 17 are made of sheet metal materials, and a thickness of the base member 10 is thicker than that of the shield member 17. This is because, although it is necessary to increase a thickness of the sheet metal of the base member 10 in order to secure rigidity of the entire of the color printer 1, the shield member 17 is configured to emit radio waves and therefore need not to have a high strength but to have a large surface area so that the shield member 17 may be made of a thin material.

As shown in FIG. 3, the base member 10 has a rectangular shape. Along the upper and lower edges and the front and rear edges of the base member 10, an upper rim portion 10*a*, a lower rim portion 10*b*, a front rim portion 10*c* and a rear rim portion 10*d* which are bent outward (leftward) are respectively formed. The driving transmitting mechanism supporting plate 11, the main substrate 12, the power supply substrate 13 and the fan 14 are stored in a recessed part surrounded by the upper rim portion 10*a*, the lower rim portion 10*b*, the front rim portion 10*c* and the rear rim portion 10*d*. On a rear upper portion of the base member 10, an attachment area to which the main substrate 12 is attached is formed. On a rear lower portion of the base member 10, an attachment area to which the power supply substrate 13 is attached is formed.

As shown in FIG. 4, the rear rim portion 10*d* of the base member 10 is formed with notches 23 and 24 each having a vertically long rectangular shape which are aligned vertically along the lower end portion. The lower notch 24 has a depth deeper than that of the upper notch 23. At a center portion in the vertical direction of a bottom edge of the lower notch 24, a shallow recess portion 25 is formed. Further, the rear rim portion 10*d* is formed with screw holes 26 at positions above the upper notch 23 and below the lower notch 24. Furthermore, the rear rim portion 10*d* is formed with a low boss 28 protruding between the upper notch 23 and the lower notch 24.

As shown in FIG. 3, along an upper edge, a lower edge and a rear edge of the shield member 17, an upper rim portion 17*a*, a lower rim portion 17*b* and a rear rim portion 17*c* which are bent inward (rightward) are respectively formed. The upper rim portion 17*a* is formed with an attachment piece 17*d* bent upward. The lower rim portion 17*b* is formed with an attachment piece 17*e* bent downward.

As shown in FIG. 5, the rear rim portion 17*c* of the shield member 17 is formed with a rectangular notch 31 and a rectangular thin part 32 recessed inward which are aligned vertically along the lower end portion. The thin part 32 has a trapezoidal notch 33. At a center portion of a bottom edge in the vertical direction of the trapezoidal notch 33, a shallow recess portion 34 is formed. Further, at both tip end portions of upper and lower edges of the trapezoidal notch 33, protrusion pieces 36 facing each other are extended.

Furthermore, the rear rim portion 17*c* of the shield member 17 is formed with circular openings 38 at a portion above the rectangular notch 31, a portion between the rectangular notch 31 and the trapezoidal notch 33 and a portion below the trapezoidal notch 33.

Figure 6A:
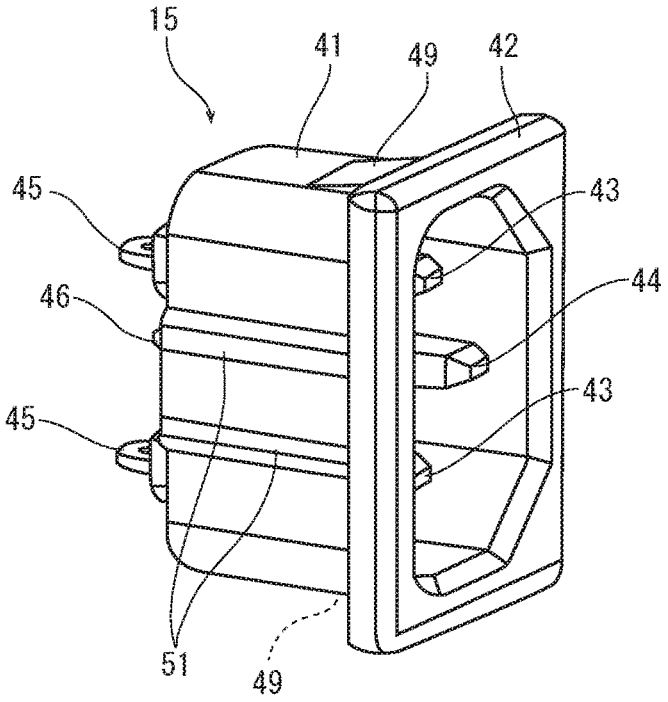
FIG. 6A is a perspective view showing an inlet viewed from a front side, in the color printer according to one embodiment of the present disclosure.
Figure 6B:
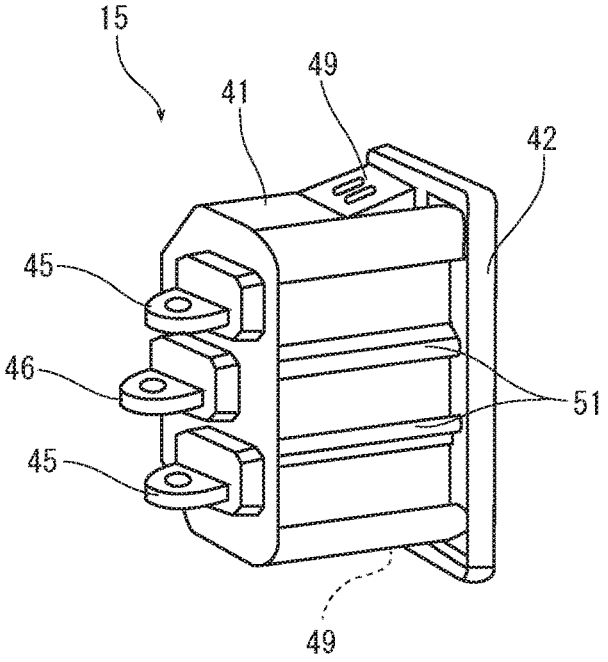
FIG. 6B is a perspective view showing the inlet viewed from a rear side, in the color printer according to one embodiment of the present disclosure.

The inlet 15 is sandwiched and fixed by the base member 10 and the shield member 17 which are plate members. The inlet 15 will be described with reference to FIGS. 6A and 6B. FIG. 6A is a perspective view showing the inlet viewed from the front face side, and FIG. 6B is a perspective view showing the inlet viewed from the rear side.

The inlet 15 includes a receptacle part 41 and a flange part 42. Into the receptacle part 41, the plug P (refer to FIG. 1) of the power cable S connected to the external power supply is inserted. The rectangular flange part 42 is protruded from a periphery edge of an opening of the receptacle part 41 in an outer direction crossing to an insertion direction (connection direction) of the power cable S. The receptacle part 41 of a rectangular shape in a plan view has tapered faces formed at corners between one side face and upper and lower faces. On an inner face of a bottom portion of the receptacle part 41, a pair of input terminals 43 and an earth input terminal 44 are protruded. Further, on an outer face of the bottom portion of the receptacle part 41, a pair of output terminals 45 and an earth output terminal 46 are protruded in a direction opposite to a protrusion direction of a pair of the input terminals 43 and the earth input terminal 44.

Furthermore, on the upper and lower faces of the receptacle part 41, claw parts 49 are protruded with predetermined intervals from the flange part 42 in the connection direction of the power cable S. Still further, on center portions of the left and right faces in the height direction of the receptacle part 41, two elongated protrusion parts 51 are horizontally formed in parallel.

Figure 7:
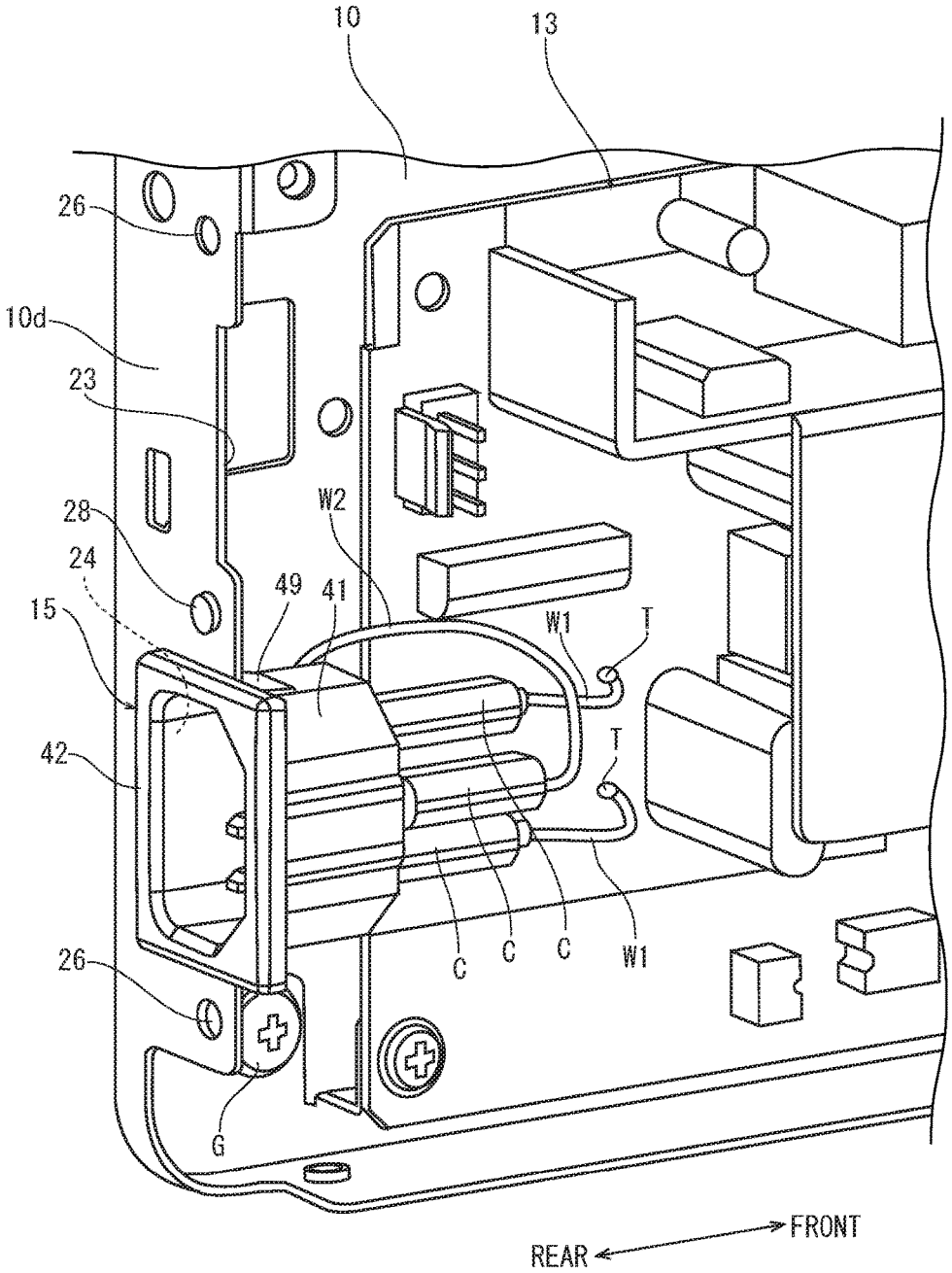
FIG. 7 is a perspective showing the inlet to which a power supply substrate is electrically connected, in the color printer according to one embodiment of the present disclosure.
Figure 8:
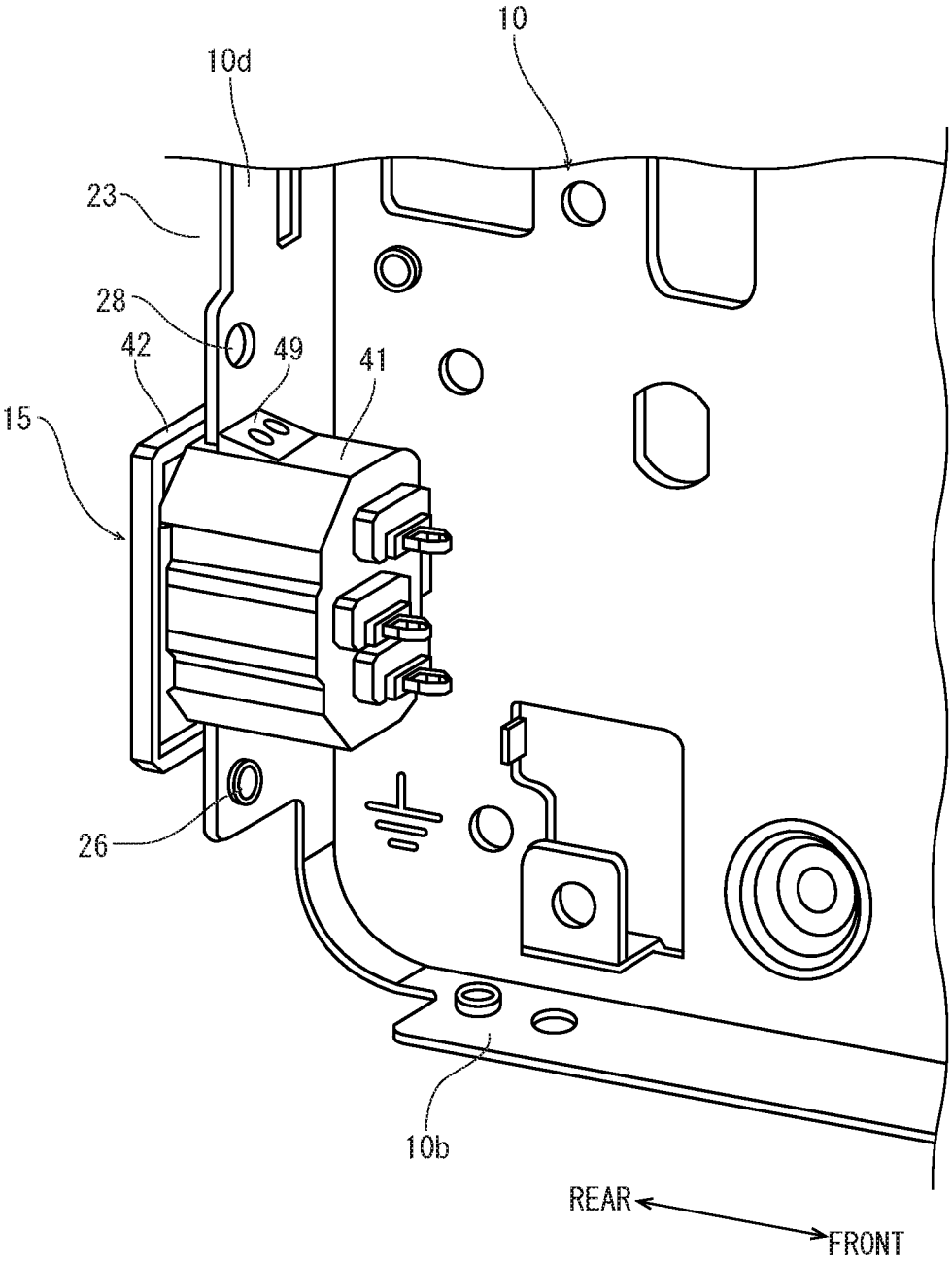
FIG. 8 is a perspective view showing the base member to which the inlet is attached, in the color printer according to one embodiment of the present disclosure.
Figure 9:
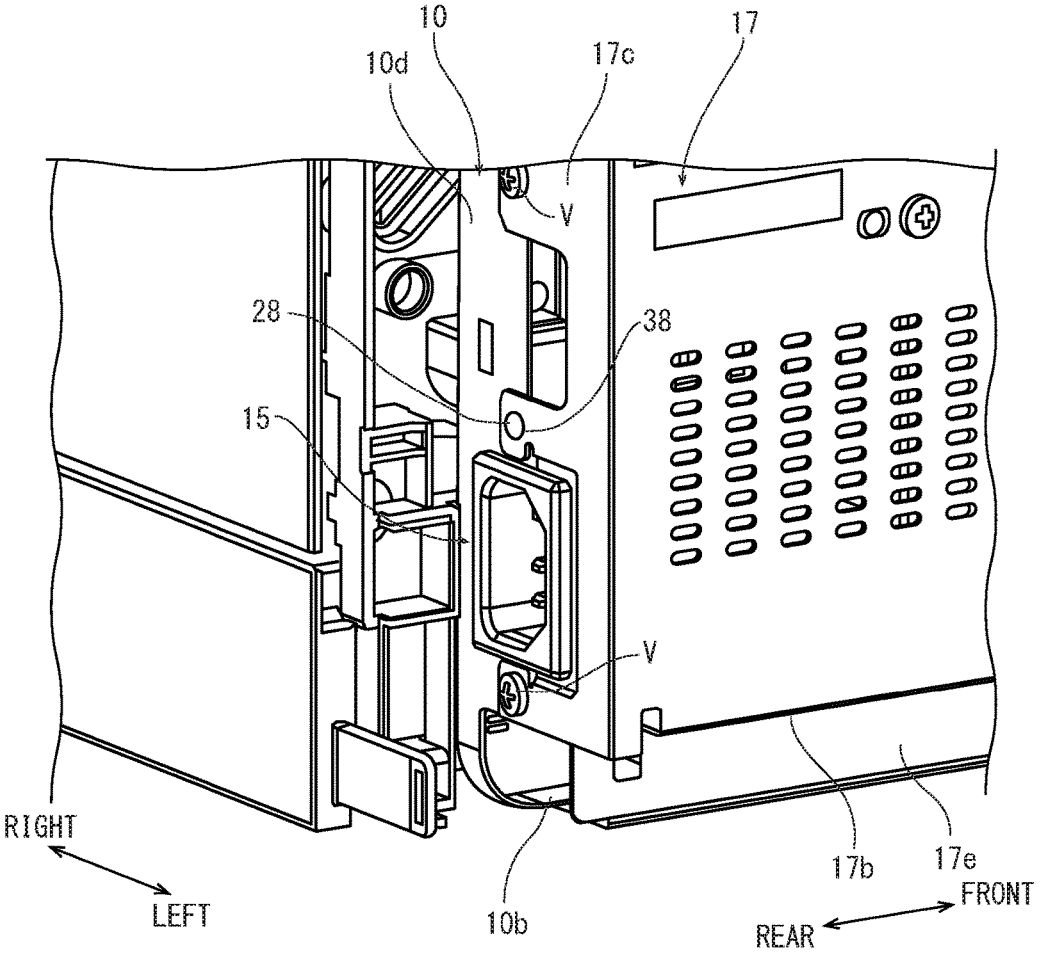
FIG. 9 is a perspective view showing the inlet supported by the base member and the shield member, in the color printer according to one embodiment of the present disclosure.
Figure 10A:
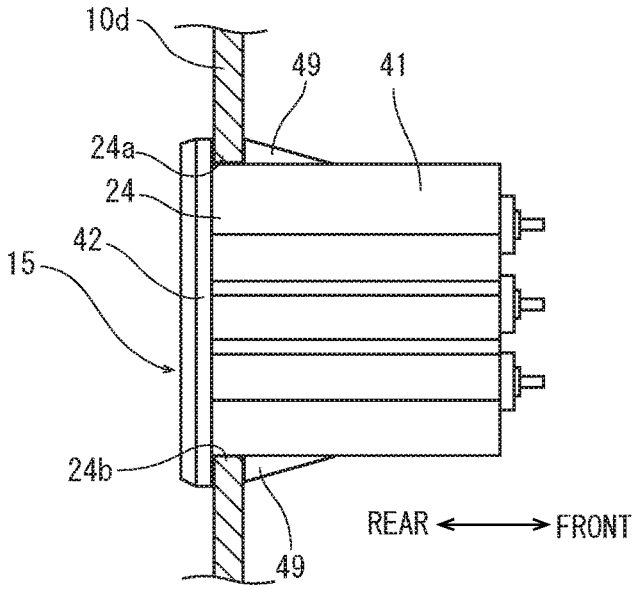
FIG. 10A is a side view showing the inlet supported by the base member and the shield member, in the color printer according to one embodiment of the present disclosure.
Figure 10B:
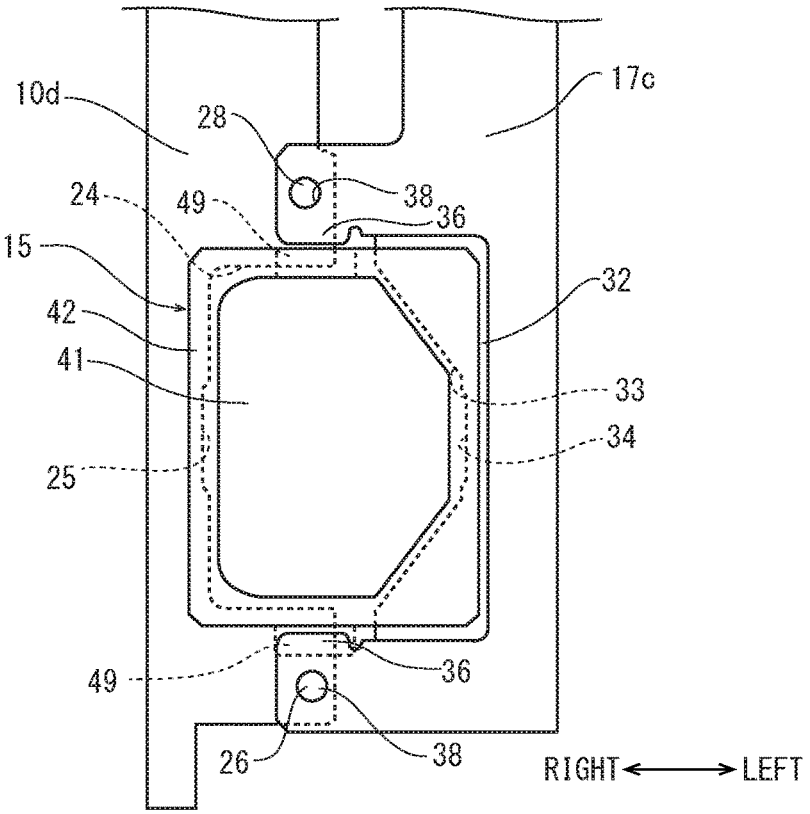
FIG. 10B is a front view showing the inlet supported by the base member and the shield member, in the color printer according to one embodiment of the present disclosure.

A method of sandwiching and fixing the inlet 15 between the base member 10 and the shield member 17 having the above configuration will be described with reference to FIGS. 7 to 10B. FIG. 7 is a perspective view showing the inlet electrically connected to the power supply substrate, FIG. 8 is a perspective view showing the base member to which the inlet is temporarily attached, FIGS. 9, 10A and 10B are views showing the inlet supported by the base member and the shield member, FIG. 9 is a perspective view, FIG. 10A is a front view, and FIG. 10B is a side sectional view.

First, as shown in FIG. 7, a pair of the output terminals 45 and the earth output terminal 46 of the inlet 15 are electrically connected to input terminals T and an earth input terminal G of the power supply substrate 13, respectively. In this time, for example, one ends of wires W1 are electrically connected with a pair of the output terminals 45 of the inlet 15 via connectors C, and the other ends of the wires W1 are soldered to the input terminals T of the power supply substrate 13. Further, one end of a wire W2 is electrically connected with the earth output terminal 46 via a connector C, and the other end of the wire W2 is fastened to the earth input terminal G of the base member 10 by way of screwing.

Furthermore, when the inlet 15 and the power supply substrate 13 are electrically connected, it is also possible to connect the one ends of the wires W1 and W2 directly to a pair of the output terminals 45 and the earth output terminal 46 respectively by soldering without using the connectors C. Alternatively, it is also possible to change the shapes of a pair of the output terminals 45 and the earth output terminal 46 so as to be directly soldered to the input terminals T and the earth input terminal G of the power supply substrate 13 respectively, and then to electrically connect the inlet 15 and the power supply substrate 13. According to these configurations, since the inlet 15 and the power supply substrate 13 are electrically and integrally connected, the connectors or the connectors and the wires are not necessary and it is possible to reduce cost of parts. Further, it is possible to reduce the number of managing process and assembly process of the parts.

Next, the inlet 15 and the power supply substrate 13 electrically connected as mentioned above are attached to the base member 10. In this time, the power supply substrate 13 is attached to the attachment area on the outer face of the base member 10, and the receptacle part 41 of the inlet 15 is fitted into the lower notch 24 formed in the rear rim portion 10*d* of the base member 10. More specifically, as shown in FIGS. 8 and 10A, the inlet 15 is held with the opening of the receptacle part 41 on the rear side, and then the upper edge 24*a* and the lower edge 24*b* of the lower notch 24 are sandwiched in gaps between the flange part 42, and the upper and lower claw parts 49. Further, when the outer face of the receptacle part 41 is made come into contact with the bottom edge of the lower notch 24, the two elongated protrusions 51 come into contact with the bottom edge of the recess portion 25. Consequently, the claw parts 49 prevents the inlet 15 from coming off from the base member 10.

Next, as shown in FIG. 9, the shield member 17 is attached to the base member 10 so as to cover the power supply substrate 13 and the main substrate 12. The rear rim portion 17*c* of the shield member 17 is overlapped outside of the rear rim portion 10*d* of the base member 10. Further, as shown in FIG. 3, the attachment piece 17*d* of the upper rim portion 17*a* comes into contact with the bottom face of the base member 10, and the attachment piece 17*e* of the lower rim portion 17*b* comes into contact with the attachment piece of the lower rim portion 10*b* of the base member 10.

When the rear rim portion 17*c* of the shield member 17 is overlapped outside of the rear rim portion 10*d* of the base member 10, the boss 28 is fitted into the center opening 38, and the receptacle part 41 of the inlet 15 is fitted into the trapezoidal notch 33. The outer face of the receptacle part 41 comes into contact with the inclined edges of the trapezoidal notch 33, and the two elongated protrusion parts 51 come into contact with the bottom edge of the recess portion 34. Further, the flange part 42 of the inlet 15 comes into contact with the thin part 32. Thus, as shown in FIGS. 10A and 10B, the receptacle part 41 of the inlet 15 is sandwiched by the lower notch 24 of the base member 10 and the trapezoidal notch 33 of the shield member 17. Further, the upper edge 24*a* and the lower edge 24*b* of the notch 24 are sandwiched between the flange part 42 and the claw parts 49 so that the inlet 15 is prevented from being coming off.

Furthermore, the attachment piece 17*d* of the upper rim portion 17*a* and the base member 10 are fastened by screws, and the attachment piece 17*e* of the lower rim portion 17*b* and the attachment piece of the lower rim portion 10*b* of the base member 10 are fastened by screws. When the shield member 17 is attached to the base member 10 as mentioned above, the upper and lower openings 38 formed in the rear rim portion 17*c* of the shield member 17 are aligned to the upper and lower screw holes 26 formed in the rear rim portion 10*d* of the base member 10.

Lastly, as shown in FIG. 9, the screws V are inserted through the upper and lower openings 39 to fasten in the screw holes 26. Thus, the shield member 17 is fixed to the base member 10, and the inlet 15 is fixed to the base member 10 and the shield member 17.

Incidentally, a switch (not shown) is sandwiched between the upper notch 33 of the rear rim portion 10*d* of the base member 10 and the rectangular notch 31 of the rear rim portion 17*c* of the shield member 17.

As mentioned above, according to the color printer 1 of the present disclosure, the base member 10 and the shield member 17 support the inlet 15 so that an attachment member to which the inlet 15 is attached is not necessary.

The inlet 15 is sandwiched by the base member 10 and the shield member 17 from the direction crossing to the connection direction (insertion direction) of the power cable S. That is, since it is not necessary to insert the inlet 15 through the opening of the attachment member, it is easy to electrically connect the inlet 15 and the power supply substrate 13 by soldering or the like and then to support the power supply substrate 13 to the base member 10. Consequently, the connectors which electrically connect the wires W1 and W2 electrically connected to the inlet 15 and the power supply substrate 13 are not necessary, and it is easy to perform an operation of connecting the inlet 15 and the power supply substrate 13. Further, when the wires W1 and W2 are soldered directly to a pair of the output terminals 45 and the earth output terminal 46, the connectors C which connect the inlet 15 and the wires W1 and W2 are not necessary, as well.

Accordingly, in order to attach the inlet 15, it is only necessary to perform an operation of electrically connecting the inlet 15 and the power supply substrate 13, an operation of attaching the electrically connected inlet 15 and power supply substrate 13 to the base member 10 and an operation of attaching the shield member 17 to the base member 10. Thus, it is possible to reduce the numbers of operation procedure compared to a conventional method.

Further, by sandwiching the inlet 15 between the notch 24 and the trapezoidal notch 33, it is easy to position the inlet 15. Incidentally, the notches may be formed in one of the base member 10 and the shield member 17.

Further, by engaging the claw parts 49 of the inlet 15 with the upper edge 24*a* and the lower edge 24*b* of the notch 24 of the base member 10, the inlet 15 is prevented from being coming off. Since the thickness of the base member 10 is thicker than that of the shield member 17, it is possible to enhance a coming off preventing strength of the inlet 15 by engaging the claw parts 49 with the base member 10. Consequently, it is possible to obtain the strength against an impact applied on the inlet 15 when the power cable S is connected and removed. Further, by engaging the inlet 15 and the base member 10 with each other as mentioned above, the thickness of the shield member 17 does not need to be made thick so that material cost does not increase. Incidentally, the claw parts 49 may be engaged with the bottom edge of the notch 24.

Further, since the base member 10 and the shield member 17 are fastened by screwing near the inlet 15, it is possible to maintain a fixing strength and the coming off preventing force of the inlet 15.

Furthermore, the thin part 32 is formed in the rear rim portion 17*c* of the shield member 17 overlapped outside, and the flange part 42 of the inlet 15 comes into contact with this thin part 32. Consequently, the flange part 42 can be sandwiched in an almost parallel posture to the rear rim portion 10*d* of the base member 10 and the rear rim portion 17*c* of the shield member 17. That is, when the thin part 32 may not be formed, a difference corresponding to the thickness of the shield member 17 is formed between the rear rim portion 17*c* of the shield member 17 overlapped outside and the rear rim portion 10*d* of the base member 10 overlapped inside. This makes it difficult to maintain the engagement state of the claw parts 49 with the upper edge 24*a* and the lower edge 24*b* of the notch 24. However, since this difference is not produced in the present embodiment, it is possible to reliably engage the claw parts 49 with the upper edge 24*a* and the lower edge 24*b* of the notch 24.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

an inlet to which a power cable can connect;

a power supply substrate to which power is supplied through the power cable via the inlet;

a main substrate on which an electrical part is mounted, a base member, shaped as a plate, to which the power supply substrate and the main substrate are attached; and a shield member, shaped as a plate, fixed to the base member so as to cover the power supply substrate and the main substrate, wherein the base member and the shield member are each formed with a side rim portion bent in a direction facing each other, each side rim portion having a notch, wherein the inlet is sandwiched between the notches in a direction crossing to a connection direction of the power cable and fixed to the base member and the shield member, and the side rim portions are overlapped with each other and fastened by screwing near the inlet.

2. The image forming apparatus according to claim 1, wherein the notches are different in shape from each other.

3. The image forming apparatus according to claim 1, wherein the base member has a thickness thicker than the shield member, the inlet includes a flange part protruded in the direction crossing to the connection direction of the power cable, and a claw part protruded at a predetermined interval from the flange part in the connection direction, and wherein a peripheral edge of the notch of the base member is sandwiched between the flange part and the claw part so that the inlet is prevented from coming off.

4. The image forming apparatus according to claim 1, wherein the side rim portion of the shield member, the side rim portion overlapped outside the side rim portion of the base member, is formed with a thin part configured to come into contact with the flange part.

5. The image forming apparatus according to claim 1, wherein the inlet and the electrical substrate are integrally connected by soldering.

* * * * *